US010042318B2

(12) United States Patent
Itani et al.

(10) Patent No.: US 10,042,318 B2
(45) Date of Patent: Aug. 7, 2018

(54) ELECTROPHOTOGRAPHIC IMAGE FORMING APPARATUS AND ELECTRICITY REMOVING MEMBER USED IN THE SAME

(71) Applicant: KYOCERA Document Solutions Inc., Osaka-shi, Osaka (JP)

(72) Inventors: Hiroka Itani, Osaka (JP); Nariaki Tanaka, Osaka (JP); Shingo Sakato, Osaka (JP); Kiyotaka Kobayashi, Osaka (JP); Takuji Watanabe, Osaka (JP); Eriko Hayashi, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/474,869

(22) Filed: Mar. 30, 2017

(65) Prior Publication Data

US 2017/0285506 A1 Oct. 5, 2017

(30) Foreign Application Priority Data

| | | |
|---|---|---|
| Mar. 31, 2016 | (JP) | 2016-073039 |
| Mar. 31, 2016 | (JP) | 2016-073040 |
| Jan. 26, 2017 | (JP) | 2017-011921 |
| Jan. 26, 2017 | (JP) | 2017-011922 |

(51) Int. Cl.
*G03G 21/00* (2006.01)
*G03G 21/06* (2006.01)

(52) U.S. Cl.
CPC ..... *G03G 21/06* (2013.01)

(58) Field of Classification Search
CPC ..... G03G 21/06
See application file for complete search history.

(56) References Cited

U.S. PATENT DOCUMENTS 4,967,231 A * 10/1990 Hosoya ..... G03G 13/08 361/221
2015/0261137 A1* 9/2015 Mitani ..... G03G 15/161 399/101

FOREIGN PATENT DOCUMENTS

JP 01154186 A 6/1989

* cited by examiner

*Primary Examiner* — Ryan Walsh
(74) *Attorney, Agent, or Firm* — Alleman Hall Creasman & Tuttle LLP

(57) ABSTRACT

An image forming apparatus includes a photoconductor and an electricity removing member electrically grounded and disposed to be in contact with a surface of the photoconductor. In the image forming apparatus, with regard to a capacitance component of an inner impedance of the electricity removing member and a capacitance component of a contact impedance of the electricity removing member that are calculated from a Cole-Cole plot obtained from measurement by an AC impedance method in a predetermined frequency range, a value obtained by dividing the capacitance component of the contact impedance by the capacitance component of the inner impedance is equal to or lower than a predetermined first specific value, and the capacitance component of the inner impedance is equal to or lower than a predetermined second specific value.

13 Claims, 6 Drawing Sheets

FIG. 7

| | INNER RESISTANCE COMPONENT | | INNER CAPACITANCE COMPONENT | | RESISTANCE RATIO | | CAPACITANCE RATIO | | ELECTRICITY REMOVING MEMBER CONDITIONS | | | | | EVALUATION RESULT | | |
|---|---|---|---|---|---|---|---|---|---|---|---|---|---|---|---|---|
| | Ra (Ω) | SATISFACTION OF CONDITION | Ca (F) | SATISFACTION OF CONDITION | Rb/Ra | SATISFACTION OF CONDITION | Cb/Ca | SATISFACTION OF CONDITION | RAW THREAD RESISTANCE (Ω) | FINENESS (μm) | DENSITY (KF/inch²) | CARBON DISTRIBUTION | SHAPE | ELECTRICITY REMOVING CAPABILITY | POTENTIAL STABILITY | IMAGE MEMORY |
| COMPARATIVE EXAMPLE 1 | 1.00E+07 | × | 1.00E+07 | × | 3.00 | × | 3.00 | × | 1.00E+07 | 30 | 100 | ENTIRE DISTRIBUTION | OPENING AND TEARING PROCESS | × | — | — |
| COMPARATIVE EXAMPLE 2 | 2.00E+06 | × | 4.00E+05 | × | 2.50 | × | 2.00 | × | 1.00E+06 | 7 | 500 | ENTIRE DISTRIBUTION | OPENING AND TEARING PROCESS | × | — | — |
| COMPARATIVE EXAMPLE 3 | 1.50E+05 | × | 3.80E+05 | × | 0.80 | × | 0.79 | × | 1.00E+06 | 7 | 500 | ENTIRE DISTRIBUTION | CIRCULAR | × | — | — |
| COMPARATIVE EXAMPLE 4 | 6.80E+05 | × | 5.80E+04 | ○ | 0.44 | × | 0.69 | × | 1.00E+05 | 7 | 500 | ENTIRE DISTRIBUTION | CIRCULAR | × | — | — |
| COMPARATIVE EXAMPLE 5 | 1.50E+05 | × | 6.50E+04 | ○ | 0.38 | ○ | 0.38 | ○ | 1.04E+05 | 6 | 550 | ENTIRE DISTRIBUTION | CIRCULAR | × | — | — |
| COMPARATIVE EXAMPLE 6 | 1.50E+05 | × | 6.50E+04 | ○ | 0.42 | × | 0.32 | ○ | 1.00E+05 | 6 | 500 | ENTIRE DISTRIBUTION | CIRCULAR | × | — | — |
| COMPARATIVE EXAMPLE 7 | 6.50E+04 | ○ | 1.50E+05 | × | 0.20 | ○ | 0.20 | ○ | 1.00E+05 | 6 | 550 | ENTIRE DISTRIBUTION | CIRCULAR | ○ | × | × |
| COMPARATIVE EXAMPLE 8 | 6.50E+04 | ○ | 2.00E+05 | × | 0.31 | ○ | 0.50 | × | 1.00E+04 | 7 | 500 | ENTIRE DISTRIBUTION | CIRCULAR | ○ | × | × |
| COMPARATIVE EXAMPLE 9 | 6.70E+04 | ○ | 8.90E+04 | ○ | 0.35 | ○ | 0.45 | × | 1.00E+05 | 6 | 580 | ENTIRE DISTRIBUTION | CIRCULAR | ○ | × | × |
| COMPARATIVE EXAMPLE 10 | 1.50E+05 | × | 3.80E+05 | × | 0.27 | ○ | 0.28 | ○ | 1.00E+06 | 7 | 500 | OUTER LAYER (TWO LAYERS) | CIRCULAR | × | — | — |
| COMPARATIVE EXAMPLE 11 | 6.90E+03 | ○ | 8.00E+05 | × | 0.03 | ○ | 0.40 | ○ | 1.00E+05 | 10 | 300 | OUTER LAYER (TWO LAYERS) | CIRCULAR | ○ | × | × |
| COMPARATIVE EXAMPLE 12 | 6.90E+04 | ○ | 4.00E+05 | × | 0.40 | ○ | 0.80 | × | 5.00E+05 | 13 | 220 | OUTER LAYER (TWO LAYERS) | CIRCULAR | ○ | × | × |
| COMPARATIVE EXAMPLE 13 | 6.90E+04 | ○ | 4.00E+05 | × | 0.80 | × | 0.80 | × | 5.04E+05 | 15 | 200 | OUTER LAYER (TWO LAYERS) | CIRCULAR | × | — | — |
| DISCLOSURE EXAMPLE 1 | 3.00E+03 | ○ | 1.50E+03 | ○ | 0.01 | ○ | 0.20 | ○ | 1.00E+04 | 7 | 500 | OUTER LAYER (TWO LAYERS) | CIRCULAR | ○ | ○ | ○ |
| DISCLOSURE EXAMPLE 2 | 5.00E+03 | ○ | 2.00E+03 | ○ | 0.01 | ○ | 0.38 | ○ | 5.80E+03 | 7 | 300 | OUTER LAYER (TWO LAYERS) | CIRCULAR | ○ | ○ | ○ |
| DISCLOSURE EXAMPLE 3 | 5.50E+03 | ○ | 1.00E+05 | ○ | 0.02 | ○ | 0.40 | ○ | 6.40E+03 | 7 | 300 | OUTER LAYER (TWO LAYERS) | CIRCULAR | ○ | ○ | ○ |

FIG. 8

| | INNER RESISTANCE COMPONENT | | INNER CAPACITANCE COMPONENT | | RESISTANCE RATIO | | CAPACITANCE RATIO | | ELECTRICITY REMOVING MEMBER CONDITIONS | EVALUATION RESULT | | |
|---|---|---|---|---|---|---|---|---|---|---|---|---|
| | Ra (Ω) | SATISFACTION OF CONDITION | Ca (F) | SATISFACTION OF CONDITION | Rb/Ra | SATISFACTION OF CONDITION | Cb/Ca | SATISFACTION OF CONDITION | HARDNESS | ELECTRICITY REMOVING CAPABILITY | POTENTIAL STABILITY | IMAGE MEMORY |
| COMPARATIVE EXAMPLE 14 | 5.00E+04 | ○ | 3.00E+04 | ○ | 120.00 | × | 133.30 | × | 79 | × | — | — |
| COMPARATIVE EXAMPLE 15 | 1.00E+04 | ○ | 1.00E+04 | ○ | 70.00 | × | 70.00 | × | 40 | × | — | — |
| DISCLOSURE EXAMPLE 4 | 1.00E+04 | ○ | 1.00E+04 | ○ | 0.38 | ○ | 0.38 | ○ | 40 | ○ | ○ | ○ |
| DISCLOSURE EXAMPLE 5 | 1.00E+04 | ○ | 1.00E+04 | ○ | 0.20 | ○ | 0.20 | ○ | 40 | ○ | ○ | ○ |

ELECTROPHOTOGRAPHIC IMAGE FORMING APPARATUS AND ELECTRICITY REMOVING MEMBER USED IN THE SAME

INCORPORATION BY REFERENCE

This application is based upon and claims the benefit of priority from the corresponding Japanese Patent Application No. 2016-073040 filed on Mar. 31, 2016, and No. 2016-073039 filed on Mar. 31, 2016, and No. 2017-011921 filed on Jan. 26, 2017, and No. 2017-011922 filed on Jan. 26, 2017, the entire contents of which are incorporated herein by reference.

BACKGROUND

The present disclosure relates to an electrophotographic image forming apparatus and an electricity removing member.

In electrophotographic image forming apparatuses, an electrostatic latent image is formed on a charged photoconductor, then it is developed by toner and a toner image is formed on the photoconductor, and after the toner image is transferred therefrom to a sheet, charges that have remained on the photoconductor are removed by an electricity removing device. Specifically, as the method for removing electricity charged on the photoconductor, there is known one that removes electricity charged on the photoconductor by causing a grounded electricity removing member to come into contact with the photoconductor.

SUMMARY

An image forming apparatus according to an aspect of the present disclosure includes a photoconductor and an electricity removing member electrically grounded and disposed to be in contact with a surface of the photoconductor. In the image forming apparatus, with regard to a capacitance component of an inner impedance of the electricity removing member and a capacitance component of a contact impedance of the electricity removing member that are calculated from a Cole-Cole plot obtained from measurement by an AC impedance method in a predetermined frequency range, a value obtained by dividing the capacitance component of the contact impedance by the capacitance component of the inner impedance is equal to or lower than a predetermined first specific value, and the capacitance component of the inner impedance is equal to or lower than a predetermined second specific value.

An image forming apparatus according to another aspect of the present disclosure includes a photoconductor and an electricity removing member electrically grounded and disposed to be in contact with a surface of the photoconductor. In the image forming apparatus, with regard to a resistance component of an inner impedance of the electricity removing member and a resistance component of a contact impedance of the electricity removing member that are calculated from a Cole-Cole plot obtained from measurement by an AC impedance method in a predetermined frequency range, a value obtained by dividing the resistance component of the contact impedance by the resistance component of the inner impedance is equal to or lower than a predetermined third specific value, and the resistance component of the inner impedance is equal to or lower than a value obtained by multiplying a calculated resistance value by a predetermined fourth specific value, the calculated resistance value being calculated, based on a predetermined formula, as a DC resistance value of the electricity removing member that is required to reduce a pre-electricity-removal potential of the photoconductor to a post-electricity-removal potential in an electricity removal time that is obtained by dividing a contact width of the photoconductor and the electricity removing member by a linear speed of the photoconductor.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 7 is a diagram showing disclosure examples and comparative examples.

FIG. 8 is a diagram showing disclosure examples and comparative examples.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

Figure 1:
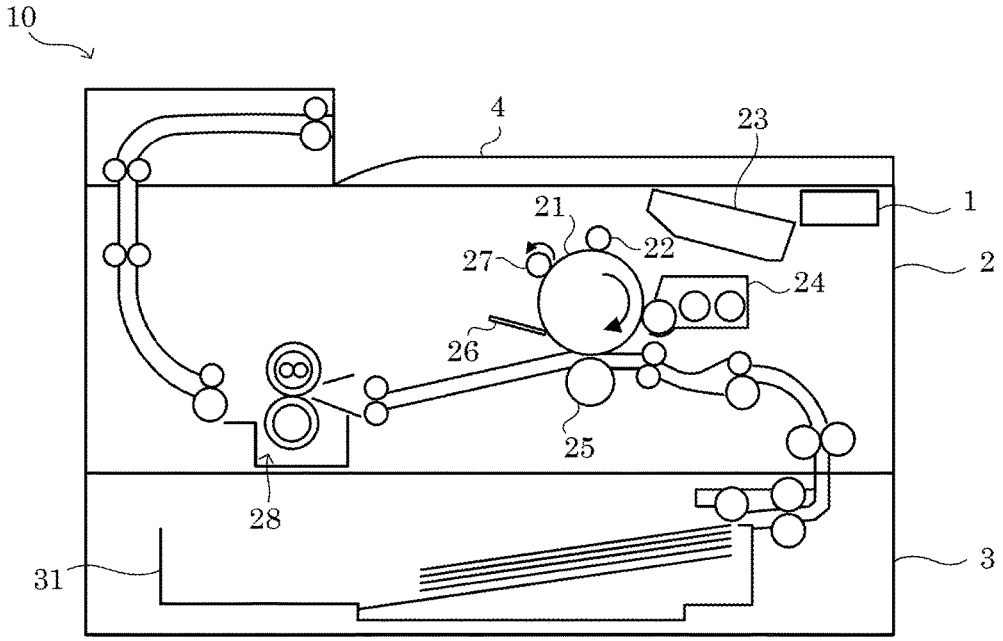
FIG. 1 is a diagram showing a configuration of an image forming apparatus according to an embodiment of the present disclosure.

As shown in FIG. 1, an image forming apparatus 10 according to an embodiment of the present disclosure is an electrophotographic monochrome printer and includes a control portion 1, an image forming portion 2, a sheet feed portion 3, and a sheet discharge portion 4. Other examples of the image forming apparatus according to the present disclosure include a facsimile, a copier, and a multifunction peripheral. In addition, the image forming apparatus according to the present disclosure is not limited to the image forming apparatus 10 supporting a monochrome printing as described in the present embodiment, but may be an electrophotographic color image forming apparatus of a tandem type or the like including a plurality of image forming portions for a plurality of colors.

The control portion 1 includes a CPU, a RAM, and a ROM and controls the image forming apparatus 10 by causing the CPU to execute various processes in accordance with control programs stored in the ROM.

The image forming portion 2 is an electrophotographic image forming portion including a photoconductor drum 21, a charging device 22, a laser scanning device 23, a developing device 24, a transfer roller 25, a cleaning member 26, an electricity removing member 27, and a fixing device 28. It is noted that the photoconductor drum 21 is an example of the photoconductor, and the photoconductor is not limited to the photoconductor drum 21, but may be a photoconductor belt, for example.

In the image forming apparatus 10, under the control of the control portion 1, the image forming portion 2 executes an image forming process (printing process) to form an image on a sheet such as a sheet of paper supplied from a sheet feed cassette 31 of the sheet feed portion 3, and the sheet after the image forming process is discharged to the sheet discharge portion 4.

Specifically, in the image forming process, the laser scanning device 23 scans a light beam on the surface of the photoconductor drum 21 charged by the charging device 22 so that an electrostatic latent image is formed based on image data. The electrostatic latent image formed on the surface of the photoconductor drum 21 is developed by the developing device 24, and is transferred to the sheet by the transfer roller 25.

Subsequently, the toner transferred to the sheet is fused and fixed to the sheet by the fixing device 28. It is noted that the toner that has remained on the surface of the photoconductor drum 21 is cleaned by the cleaning member 26. In addition, charges that have remained on the photoconductor drum 21 are removed by the electricity removing member 27 which is disposed on the downstream side of the cleaning member 26.

The photoconductor drum 21 is, for example, an organic photoconductor (OPC) having a single-layer structure in which a photosensitive layer is formed around an aluminum tube, wherein the photosensitive layer contains a charge generating material and a charge transport material. The charge generating material is, for example, a perylene-based pigment, a phthalocyanine-based pigment or the like. The charge transport material is, for example, a hydrazone-based compound, a fluorenone-based compound, an arylamine-based compound or the like.

Specifically, the photoconductor drum 21 is a positive-charged single layer photoconductor (PSLP) drum. It is noted that as another embodiment, the photoconductor drum 21 may be an organic photoconductor having a multi-layer structure.

Figure 2:
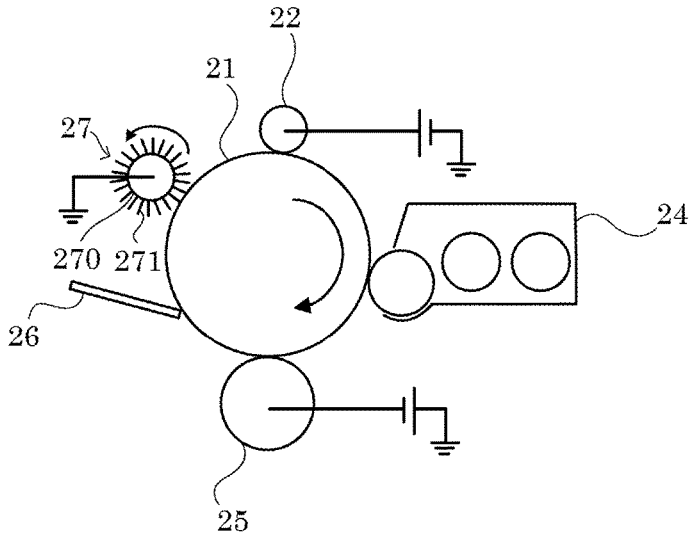
FIG. 2 is a diagram for explaining a main part of an image forming portion of the image forming apparatus according to the embodiment of the present disclosure.

As shown in FIG. 2, the charging device 22 includes a charging roller that is in contact with the photoconductor drum 21, and charges the photoconductor drum 21 to a predetermined charging potential by causing the charging roller to apply a positive DC voltage to the photoconductor drum 21. That is, the charging device 22 of the present embodiment is neither an AC-superposing-type charging device that superposes an AC voltage on a DC voltage, nor a contactless charging device, such as a scorotron charger, that charges the photoconductor drum 21 in a contactless manner. It is noted that as another embodiment, the charging device 22 may be an AC-superposing-type charging device or a contactless charging device.

The electricity removing member 27 is electrically grounded. In addition, the electricity removing member 27 is supported in such a way as to rotate while in contact with the surface of the photoconductor drum 21, and rotates following the rotation of the photoconductor drum 21. The electricity removing member 27 is a brush-like roller member formed from a conductive metal material or resin material. As shown in FIG. 2, the electricity removing member 27 includes a basic body portion 270 and brush bristles 271, wherein the basic body portion 270 is cylindrical, and one end of the brush bristles 271 is fixed to the basic body portion 270 and the other end is brought into contact with the surface of the photoconductor drum 21. In addition, the electricity removing member 27 is not limited to a brush-like shape, but may be a cylindrical (roll-shaped) roller member formed from a conductive metal material or resin material. The resin material is, for example, rubber or sponge.

Meanwhile, in a configuration where the electricity removing member 27 is in contact with the photoconductor drum 21, as in the image forming apparatus 10, the electric characteristic, such as the inner capacitance, of the electricity removing member 27 may influence the potential stability and the memory image presence/absence on the surface of the photoconductor drum 21. However, not only the inner capacitance of the electricity removing member 27, but also the contact capacitance of the electricity removing member 27 influences the potential stability and the memory image presence/absence.

In addition, in the image forming apparatus 10, an electric characteristic, such as an inner resistance, of the electricity removing member 27 influences the electricity removing capability. However, not only the inner resistance of the electricity removing member 27 but also a contact resistance of the electricity removing member 27 influences the electricity removing capability. Specifically, since the photoconductor drum 21 has a high surface resistance value, a horizontal flow of charges does not occur on the surface of the photoconductor drum 21. As a result, even if the inner resistance of the electricity removing member 27 is low, if the contact resistance with the photoconductor drum 21 is high, charges cannot be removed effectively from the photoconductor drum 21.

In a case where, as in the present embodiment, the contact-type charging device 22 that is in contact with the photoconductor drum 21 is used, generation of VOC (volatile organic compounds) is suppressed, compared to a contactless charging device such as a scorotron charger that charges the photoconductor drum 21 in a contactless manner. However, contact-type charging devices may be inferior to contactless charging devices in charging performance. In addition, the charging device 22 is of a type that applies a DC voltage. This may lower the charging performance.

On the other hand, as described below, the image forming apparatus 10 is configured such that the electric characteristic of the electricity removing member 27 satisfies a predetermined first specific condition. With this configuration, it is possible to improve the potential stability by taking the contact capacitance also into consideration and suppress an occurrence of the memory image. In addition, as described below, the image forming apparatus 10 is configured such that the electric characteristic of the electricity removing member 27 satisfies a predetermined second specific condition. With this configuration, it is possible to improve the electricity removing capability by taking into consideration also the contact resistance of the electricity removing member 27.

Figure 3:
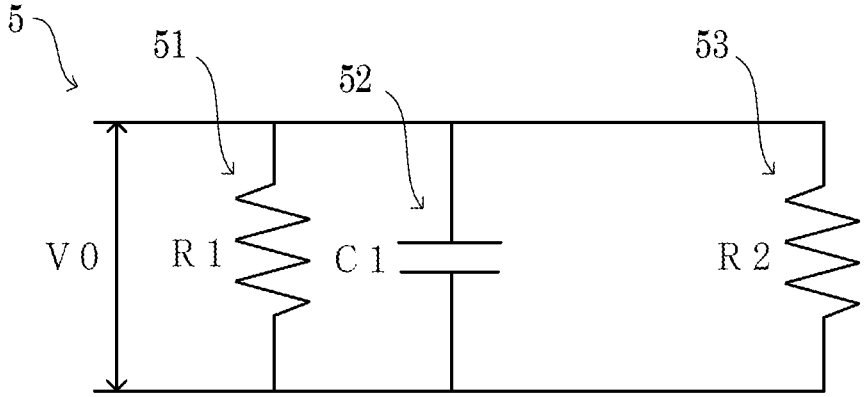
FIG. 3 is a diagram showing an equivalent circuit for explaining electric characteristics between a photoconductor and an electricity removing member of the image forming apparatus according to the embodiment of the present disclosure.

FIG. 3 shows an an equivalent circuit 5 that indicates electric characteristics between the photoconductor drum 21 and the electricity removing member 27 of the image forming portion 2. As shown in FIG. 3, in the equivalent circuit 5, a resistor 51, a capacitor 52, and a resistor 53 are connected in parallel, wherein the resistor 51 corresponds to a DC resistance value R1 of the photoconductor drum 21, the capacitor 52 corresponds to a capacitance C of the photoconductor drum 21, and the resistor 53 corresponds to a DC resistance value R2 of the electricity removing member 27.

It is generally considered that in the equivalent circuit 5, the lower the DC resistance value R2 of the electricity removing member 27 is, the higher the electricity removing capability of the photoconductor drum 21 by the electricity removing member 27 is. However, it has been found that, in the actuality, not only the DC resistance value R2 of the electricity removing member 27, but also the contact resistance between the electricity removing member 27 and the photoconductor drum 21 influences the electricity removing capability.

Figure 4:
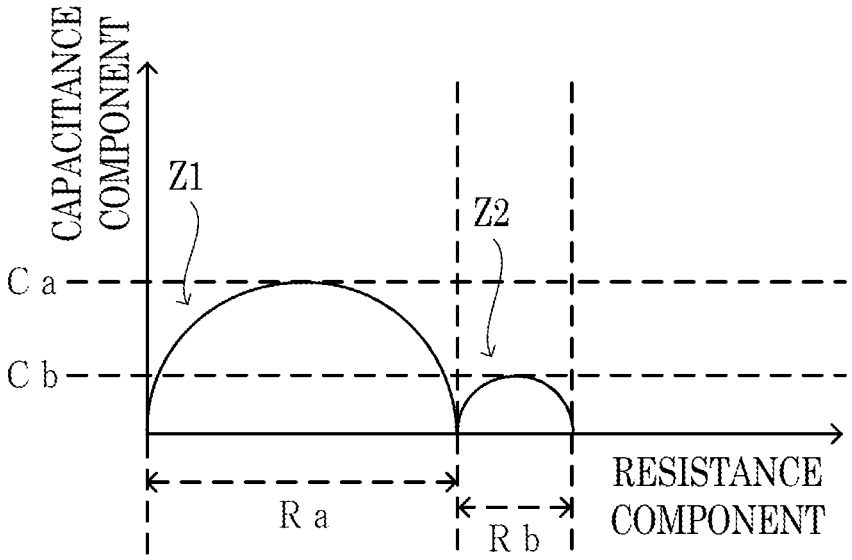
FIG. 4 is a diagram showing a Cole-Cole plot of the electricity removing member of the image forming apparatus according to the embodiment of the present disclosure.

When an inner impedance Z1 and a contact impedance Z2 of the electricity removing member 27 are measured by the AC impedance method in a predetermined frequency range of, for example, 0.05 Hz to 100 kHz, a Cole-Cole plot as shown in FIG. 4 is obtained. From this plot, an inner resistance component Ra and an inner capacitance component Ca of the inner impedance Z1, and a contact resistance component Rb and a contact capacitance component Cb of the contact impedance Z2 can be calculated. Here, in the Cole-Cole plot shown in FIG. 4, the inner impedance Z1 and the contact impedance Z2 are plotted as semicircles. However, they may each be plotted as a circular arc such as a semielliptical shape.

In the present embodiment, it is assumed that the resistance between the core metal of the photoconductor drum 21 and the photosensitive layer can be ignored. In addition, the DC resistance value R1 of the photoconductor drum 21 is very high relative to the DC resistance value R2 of the electricity removing member 27. As a result, a combined resistance R3 of the photoconductor drum 21 and the electricity removing member 27 can be considered the same as the DC resistance value R2 of the electricity removing member 27.

Suppose here that "t" denotes an electricity removal time during which the photoconductor drum 21 is in contact with the electricity removing member 27, V1 denotes a post-electricity-removal potential that is determined in advance as a target value of the surface potential of the photoconductor drum 21 after an elapse of the electricity removal time t, V0 denotes a pre-electricity-removal potential of the photoconductor drum 21 at the start of the electricity removal by the electricity removing member 27, and C denotes the capacitance of the photoconductor drum 21. In this case, a theoretical value of the DC resistance value R2 of the electricity removing member 27 (hereinafter, the value is referred to as "calculated resistance value R21") with which the surface potential of the photoconductor drum 21 is changed from the pre-electricity-removal potential V0 to the post-electricity-removal potential V1 in the electricity removal time t, is calculated based on the following formula (1). It is noted that when S denotes a linear speed (surface speed) of the photoconductor drum 21, and L denotes a contact width of the photoconductor drum 21 and the electricity removing member 27 in the rotation direction of the photoconductor drum 21, the electricity removal time t is calculated as L/S.

[Math 1]

$$V1=V0\times e^{-t/(R21\cdot C)} \tag{1}$$

However, as described above, the contact impedance of the electricity removing member 27 and the photoconductor drum 21 also influences the electricity removing capability of the electricity removing member 27. As a result, in the image forming apparatus 10, the electricity removing member 27 is configured in such a way as to satisfy the conditions of the following formulas (2) and (3).

$$Ra\leq R21\times 3 \tag{2}$$

$$0\leq Rb/Ra\leq 0.4 \tag{3}$$

That is, in the image forming apparatus 10, as shown in the formula (2), the inner resistance component Ra of the electricity removing member 27 is equal to or lower than a value obtained by multiplying the calculated resistance value R21 of the electricity removing member 27 by 3 (three), wherein "3" is an example of the predetermined fourth specific value. In addition, in the image forming apparatus 10, as shown in the formula (3), a resistance ratio (Rb/Ra) obtained by dividing the contact resistance component Rb by the inner resistance component Ra of the electricity removing member 27 is equal to or lower than 0.4, wherein "0.4" is an example of the predetermined third specific value.

In this way, the image forming apparatus 10 is configured such that the electric characteristics of the electricity removing member 27 are determined by taking into consideration not only the DC resistance value R2 of the electricity removing member 27, but also the inner resistance component Ra and the contact resistance component Rb. With this configuration, it is possible to improve the electricity removing capability of the electricity removing member 27. On the other hand, the actual value of the DC resistance value R2 of the electricity removing member 27 may be equal to or lower than the calculated resistance value R21, or higher than the calculated resistance value R21.

Specifically, the contact resistance component Rb of the photoconductor drum 21 and the electricity removing member 27 is sufficiently low relative to the inner resistance component Ra that is defined to be equal to or lower than a value obtained by multiplying, by 3 (three), the calculated resistance value R21 with which the surface potential of the photoconductor drum 21 is changed by the electricity removal to the post-electricity-removal potential V1 in the electricity removal time t. With this configuration, the electricity removing capability of the electricity removing member 27 is improved. It is noted that the third and fourth specific values are not limited to the above-mentioned values as far as similar effects are provided.

Figure 9:
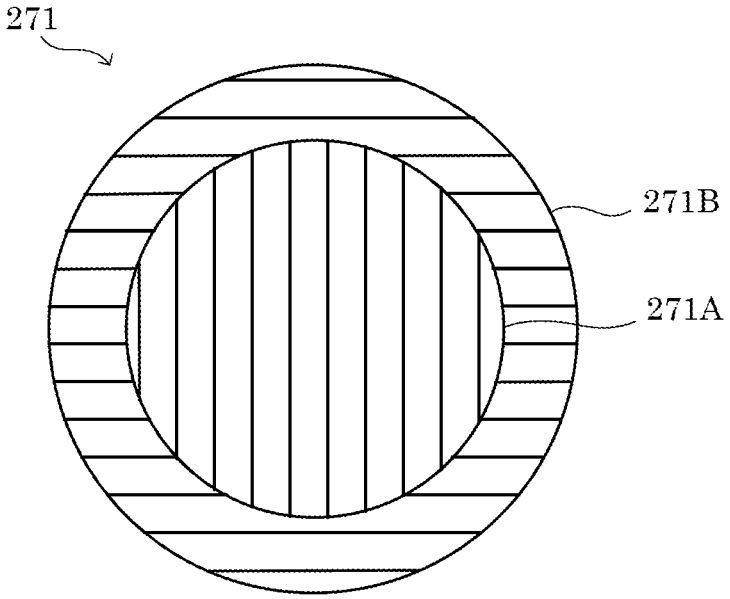
FIG. 9 is a diagram showing a configuration of a brush bristle of the electricity removing member of the image forming apparatus according to the embodiment of the present disclosure.

As shown in FIG. 9, in the image forming apparatus 10, each of the brush bristles 271 of the electricity removing member 27 includes a core portion 271A and a surface layer portion 271B, for example. Here, FIG. 9 is a cross section of one brush bristle 271. The core portion 271A is made of resin. The surface layer portion 271B is made of carbon, and covers the surface of the core portion 271A. The surface layer portion 271B is, for example, formed together with the core portion 271A when the brush bristle 271 is manufactured. In addition, the surface layer portion 271B may be formed, after the core portion 271A is formed, by spraying carbon to the surface of the core portion 271A. With this configuration, compared to a configuration where each of the brush bristles 271 is composed of only a resin layer that contains carbon, it is possible to reduce the inner resistance component Ra and the contact resistance component Rb of the electricity removing member 27, while maintaining the strength of the brush bristles 271. It is noted that the surface layer portion 271B may contain a component other than carbon as far as the electricity removing member 27 satisfies the above-indicated formulas (2) and (3). In addition, the core portion 271A may contain carbon. In addition, each of the brush bristles 271 may be composed of only a resin layer that contains carbon.

In addition, as described above, the contact impedance of the electricity removing member 27 with the photoconductor drum 21 also influences the potential stability and the memory image presence/absence on the surface of the photoconductor drum 21. In the image forming apparatus 10, the electricity removing member 27 is configured in such a way as to satisfy the conditions of the following formulas (4) and (5) as well.

$$Ca \leq 1.0E+05 \quad (4)$$

$$0 \leq Cb/Ca \leq 0.4 \quad (5)$$

That is, in the image forming apparatus 10, as shown in the formula (4), the inner capacitance component Ca of the electricity removing member 27 is equal to or lower than "1.0E+05" that is an example of the predetermined second specific value. In addition, in the image forming apparatus 10, as shown in the formula (5), a capacitance ratio (Cb/Ca) that is obtained by dividing the contact capacitance component Cb of the electricity removing member 27 by the inner capacitance component Ca is equal to or lower than 0.4, wherein "0.4" is an example of the predetermined first specific value.

In this way, in the image forming apparatus 10, with the configuration where the electric characteristics of the electricity removing member 27 are determined by taking into consideration the inner capacitance component Ca and the contact capacitance component Cb of the electricity removing member 27, it is possible to improve the potential stability of the photoconductor drum 21 and suppress an occurrence of the image memory. Specifically, the inner capacitance component Ca is determined in such a way as to reduce the amount of charge that is collected in the electricity removing member 27, and the ratio of the contact capacitance component Cb to the inner capacitance component Ca is low, thus the charge is likely to leak from the electricity removing member 27. This makes it possible to improve the potential stability and suppress an occurrence of the image memory. It is noted that the values of the first and second specific values are not limited to those described above.

EXAMPLES

The following explains the measurement results of the image forming apparatus 10 with reference to FIG. 5 to FIG. 8.

Figure 5:
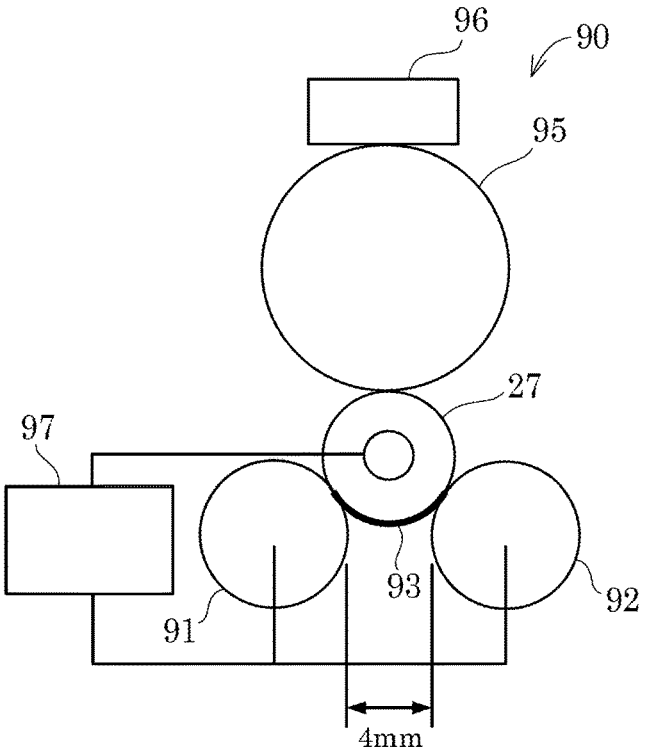
FIG. 5 is a diagram showing an experiment device used to obtain results shown in the Cole-Cole plot of the electricity removing member of the image forming apparatus according to the embodiment of the present disclosure.
Figure 6:
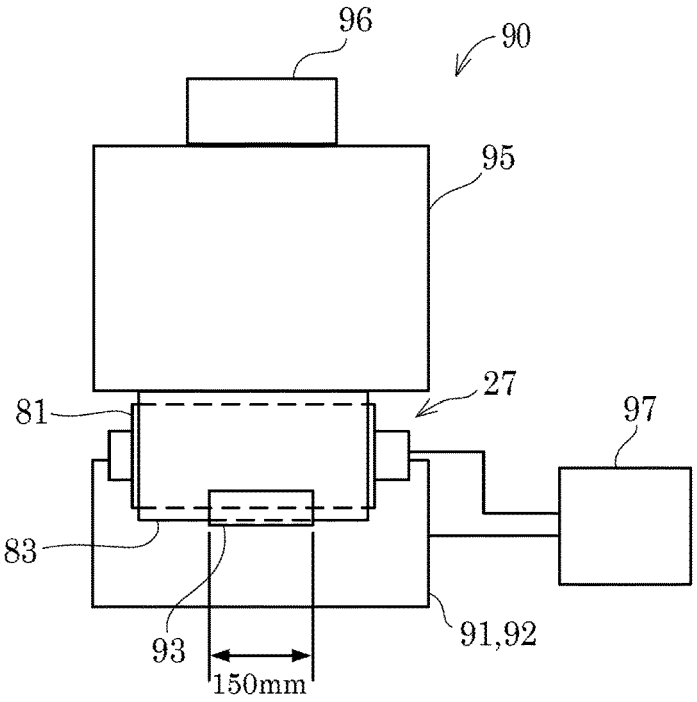
FIG. 6 is a diagram showing the experiment device used to obtain results shown in the Cole-Cole plot of the electricity removing member of the image forming apparatus according to the embodiment of the present disclosure.

FIG. 5 and FIG. 6 show an experiment device 90 that measures the inner resistance component Ra, the contact resistance component Rb, the inner capacitance component Ca and the contact capacitance component Cb of the electricity removing member 27. The experiment device 90 includes two SUS rollers 91 and 92 aligned in the horizontal direction with 4 mm of distance therebetween, each of which is made of stainless steel and 18 mm in diameter. A film electrode 93 made of aluminum and having 150 mm of horizontal length is suspended between the SUS roller 91 and the SUS roller 92. Each of the electricity removing members 27 of comparative examples 1 to 15 and disclosure examples 1 to 5 that are the experiment objects, is disposed to be in contact with the upper surface of the film electrode 93.

In addition, the experiment device 90 includes a SUS roller 95 that has 30 mm of diameter and is disposed on the electricity removing member 27. A weight 96 of 1 kg applies a downward load to the SUS roller 95, and the load is applied to the electricity removing member 27 via the SUS roller 95. The experiment is conducted in a state where the electricity removing member 27 and the SUS rollers 91, 92 and 95 are not rotating. The two SUS rollers 91 and 92 are connected to one electrode of an impedance measuring equipment 97 (LCR HiTESTER 3522 made by Hioki E. E. Corporation), and a base body 81 of the electricity removing member 27 is connected to the other electrode of the impedance measuring equipment 97. In this state, the impedance measurement is performed by the impedance measuring equipment 97. In this experiment, a sinusoidal AC voltage whose voltage value is 5.0 V is applied to ends of the two electrodes of the impedance measuring equipment 97. The inner resistance component Ra, the contact resistance component Rb, the inner capacitance component Ca, and the contact capacitance component Cb of the electricity removing member 27 are measured while changing the frequency of the applied AC voltage in a range from 0.05 Hz to 100 kHz. The measurement was performed a plurality of times (2 to 16 times). Tables of FIG. 7 and FIG. 8 show experiment results based on the average values of the measured values.

FIG. 7 and FIG. 8 also show evaluation results of the electricity removing capability of the photoconductor drum 21 by the electricity removing member 27, the potential stability, and the image memory presence/absence that were obtained by causing the image forming apparatus 10 loaded with the electricity removing member 27 of the examples shown in FIG. 7 and FIG. 8, to execute the image forming process.

Here, with regard to the electricity removing capability, after the electricity removal of the photoconductor drum 21 had been performed by the electricity removing member 27, an evaluation was made on whether the potential of the photoconductor drum 21 was reduced to a desired post-electricity-removal potential V1. In FIG. 7, signs "○" and "x" are used to indicate the evaluation result of the electricity removing capability, wherein the sign "○" indicates that the potential was reduced to the desired post-electricity-removal potential V1, and the sign "x" indicates that the potential was not reduced to the desired post-electricity-removal potential V1.

With regard to the electricity removing capability, after a continuous printing of 60 minutes had been performed in the image forming apparatus 10, the surface potential of the photoconductor drum 21 after charging by the charging device 22 was measured, and an evaluation was made on whether the surface potential was reduced by 10% or more from the initial surface potential after charging by the charging device 22 before the start of the continuous printing. In FIG. 7, signs "○" and "x" are used to indicate the evaluation result of the potential stability, wherein the sign "○" indicates that the surface potential was not reduced by 10% or more from the initial surface potential, and the sign "x" indicates that the surface potential was reduced by 10% or more from the initial surface potential. The reason why the value "10%" was adopted is that when the surface potential is reduced by 10% or more from the initial surface potential, a problem such as a fog may occur.

With regard to the image memory presence/absence, after the image forming apparatus 10 had performed the image forming process to form a black patch of a predetermined shape on the front end of the print sheet and form a half image (gray image) on the other region of the print sheet, an evaluation was made visually on whether or not an image memory was generated. Specifically, when the shape of the black patch appeared in the half image region, it was determined that an image memory was generated. In FIG. 7, signs "○" and "x" are used to indicate the evaluation result of the image memory presence/absence, wherein the sign "○" indicates that an image memory was not generated, and the sign "x" indicates that an image memory was generated.

More specifically, a remodeled version of printer "FS-1320DN" made by KYOCERA Document Solutions Inc. was used as the image forming apparatus 10 in the experiment. In addition, in the image forming apparatus 10, the pre-electricity-removal potential V0 of the photoconductor drum 21 was 500 V, the surface speed (linear speed) of the photoconductor drum 21 was 0.15 m/s, and the contact width L was 0.005 m. In addition, the vacuum permittivity ε0 was (8.9E−12) F/m, the relative permittivity εr of the photoconductor drum 21 was 3.5, and the film thickness d of the photoconductor drum 21 was (3.5E−05) m. In this case, the capacitance C of the photoconductor drum 21 was calculated as (8.85E−07) F from "ε0×εr/d".

Furthermore, the post-electricity-removal potential V1 that is a desired potential after an electricity removal of the photoconductor drum 21 by the electricity removing member 27 was set to 100 V. In this case, from the above-indicated formula (1), the calculated resistance value R21 of the electricity removing member 27 is calculated as 2.3E+04Ω. As a result, when the inner resistance component Ra of the electricity removing member 27 is equal to or lower than 6.9E+04Ω that is three times the calculated resistance value R21, the above-indicated formula (2) is satisfied. It is noted that the post-electricity-removal potential V1 may be calculated by, for example, an expression "V1=V0×0.2", or, to provide a margin, may be calculated by, for example, an expression "V1=V0×0.22+80".

In the comparative examples 1 to 13 and the disclosure examples 1 to 3, the electricity removing member 27 was a brush-like roller member.

In the comparative example 1, the brush-like electricity removing member 27 was formed by using raw threads that were prepared by performing an opening and tearing process on a conductive acrylic fiber SA7 made by Toray Industries, Incorporated. In the electricity removing member 27 of the comparative example 1, the raw thread resistance was 1.00E+07Ω, the brush fineness was 30 μm, namely high (fiber was thick), and the brush density was 100 kF/inch$^2$, namely low. It is noted that the comparative examples 1 to 9 were an entire distribution system where carbon of the fiber was distributed in the entire region of the raw thread.

In the comparative example 2, as in the comparative example 1, the brush-like electricity removing member 27 was formed by using raw threads that were prepared by performing the opening and tearing process on the conductive acrylic fiber SA7 made by Toray Industries, Incorporated. In the electricity removing member 27 of the comparative example 2, the raw thread resistance was 1.00E+06Ω, the brush fineness was 7 μm, namely low (fiber was thin), and the brush density was 500 kF/inch$^2$, namely high.

In the comparative example 3, the brush-like electricity removing member 27 was formed by using raw threads of a conductive nylon UUN made by Unitika Limited. In the electricity removing member 27 of the comparative example 3, the raw thread resistance was 1.00E+0.6Ω, the brush fineness was 7 μm, namely low (fiber was thin), and the brush density was 500 kF/inch$^2$, namely high. It is noted that in the comparative examples 3 to 13 and the disclosure examples 1 to 3, the fiber cross sectional shape of the electricity removing member 27 was circular.

In the comparative examples 4 to 6, as in the comparative example 3, the brush-like electricity removing member 27 was formed by using raw threads of the conductive nylon UUN made by Unitika Limited. In the electricity removing member 27 of the comparative examples 4 to 6, the raw thread resistance was 1.00E+05Ω, 1.04E+05Ω, and 1.00E+0.5Ω, respectively. In addition, in the electricity removing member 27 of the comparative examples 4 to 6, the brush fineness was 7 μm, 6 μm, and 6 μm, respectively. In addition, in the electricity removing member 27 of the comparative examples 4 to 6, the brush density was 500 kF/inch$^2$, 550 kF/inch$^2$, and 500 kF/inch$^2$, respectively.

In the comparative examples 7 to 9, as in the comparative example 3, the brush-like electricity removing member 27 was formed by using raw threads of the conductive nylon UUN made by Unitika Limited. On the other hand, the electricity removing member 27 of the comparative examples 7 to 9 had more amount of carbon in the fiber than the comparative example 3 so that values of the inner resistance component Ra and the resistance ratio (Rb/Ra) were lower than those of the comparative example 3. In the electricity removing member 27 of the comparative examples 7 to 9: the raw thread resistance was 1.00E+05Ω, 1.00E+0.4Ω, and 1.00E+05Ω, respectively; the brush fineness was 6 μm, 7 μm, and 6 μm, respectively, namely low (fiber was thin); and the brush density was 550 kF/inch$^2$, 500 kF/inch$^2$, and 580 kF/inch$^2$, respectively, namely high.

In the disclosure example 1, the brush-like electricity removing member 27 was formed by using raw threads of GBN fiber made by KB Seiren, Ltd. In the electricity removing member 27 of the disclosure example 1, the raw thread resistance was 1.00E+04Ω, the brush fineness was 7 μm, namely low (fiber was thin), and the brush density was 500 kF/inch$^2$, namely high. In addition, in the electricity removing member 27 of the disclosure examples 1 to 3 and the comparative examples 10 to 13, the carbon presence state in the fiber was not the entire distribution system, but was a two-layer structure where carbon was present in the outer portion of the fiber, and the contact resistance component had been reduced and the resistance ratio (Rb/Ra) had become low.

In the comparative example 10, as in the disclosure example 1, the brush-like electricity removing member 27 was formed by using raw threads of GBN fiber made by KB Seiren, Ltd. However, the electricity removing member 27 of the comparative example 10 differed from that of the disclosure example 1 in that it was higher in raw thread resistance than the electricity removing member 27 of the disclosure example 1 by two digits.

In the comparative examples 11 to 13, the brush-like electricity removing member 27 was formed by using threads that were prepared by spraying carbon to polyester raw threads. In the electricity removing member 27 of the comparative examples 11 to 13, carbon was sprayed to the polyester raw threads such that values of the inner resistance component Ra and the resistance ratio (Rb/Ra) became lower. It is noted that in the comparative examples 11 to 13 and the disclosure example 3, the same amount of carbon was sprayed, and the comparative examples 11 to 13 differed from the disclosure example 3 in fineness and density of the polyester raw threads.

In the disclosure example 2, the brush-like electricity removing member 27 was formed by using polyester raw threads. In the electricity removing member 27 of the disclosure example 2, the raw thread resistance was 5.8E+03Ω, the brush fineness was 7 μm, namely low (fiber was thin), and the brush density was 300 kF/inch$^2$, namely high. In addition, in the disclosure example 2, as in the disclosure example 1, the electricity removing member 27 had the two-layer structure where carbon was present in the outer portion of the fiber, but carbon particles were directly sprayed to the outer portion of the fiber. With this structure, the same level of electric characteristic as the disclosure example 1 was realized with the brush density lower than the disclosure example 1.

In the disclosure example 3, the brush-like electricity removing member 27 was formed by using polyester raw threads. In the electricity removing member 27 of the disclosure example 3, the raw thread resistance was 6.4E+03Ω, the brush fineness was 7 μm, namely low (fiber was thin), and the brush density was 300 kF/inch$^2$, namely high. In addition, in the disclosure example 3, as in the disclosure example 1, the electricity removing member 27 had the two-layer structure where carbon was present in the outer portion of the fiber, but carbon particles were directly sprayed to the outer portion of the fiber. It is noted that in the disclosure example 3, a smaller amount of carbon was sprayed than in the disclosure example 2.

The electricity removing member 27 of the comparative examples 14 to 15 and the disclosure examples 4 to 5 was a roller member of a cylindrical shape (roll shape).

In the comparative example 14, a rubber roller was used as the electricity removing member 27, wherein in the rubber roller, hardness measured by an ASKER C-type hardness meter was 79, the inner resistance component Ra was 5.00E+04, and the resistance ratio (Rb/Ra) was 120.00. It is noted that the rubber roller used in the comparative examples 14 to 15 and the disclosure examples 4 to 5 includes a metal shaft, and an inner layer and an outer layer that cover the metal shaft. The inner layer of the rubber roller was formed from, for example, polyurethane, silicone rubber, EPDM, epichlorohydrin-ethylene oxide copolymer rubber, epichlorohydrin-ethylene oxide-allyl glycidyl ether copolymer rubber, NBR, or a blend rubber thereof. In addition, the outer layer of the rubber roller was formed from, for example, a material containing polyamide particles, carbon black, or dimethyl polysiloxane. In addition, the outer layer of the rubber roller may be formed from, for example, a material impregnated with a surface treating liquid containing isocyanate compound, or a carbon tube.

In the comparative example 15, a rubber roller was used as the electricity removing member 27, wherein in the rubber roller, the hardness measured by an ASKER C-type hardness meter was 40, the inner resistance component Ra was 1.00E+04, and the resistance ratio (Rb/Ra) was 70.00. It is noted that the electricity removing member 27 of the comparative example 15 was lower in hardness than the comparative example 14, and the contact area between the photoconductor drum 21 and the electricity removing member 27 was broader than that of the comparative example 14, thus the inner resistance component Ra was low, but the effect of improving the contact resistance component Rb was small.

In the disclosure example 4, a rubber roller whose outer layer was a carbon-rich low-resistance layer having an increased amount of carbon, was used as the electricity removing member 27. In the electricity removing member 27 of the disclosure example 4, the inner resistance component Ra was 1.00E+04, and the resistance ratio (Rb/Ra) was 0.38. In addition, in the electricity removing member 27 of the disclosure example 4, the inner capacitance component Ca was 1.00E+04, and the capacitance ratio (Cb/Ca) was 0.38.

In the disclosure example 5, a rubber roller whose surface layer had been subjected to vapor deposition of carbon was used as the electricity removing member 27, and the disclosure example 5 was higher than the disclosure example 4 in carbon abundance ratio in the surface layer. In the electricity removing member 27 of the disclosure example 5, the inner resistance component Ra was 1.00E+04, and the resistance ratio (Rb/Ra) was 0.20. In addition, in the electricity removing member 27 of the disclosure example 5, the inner capacitance component Ca was 1.00E+04, and the capacitance ratio (Cb/Ca) was 0.20.

Each value shown in FIG. 7 and FIG. 8, of the resistance ratio (Rb/Ra), namely a ratio of the contact resistance component Rb to the inner resistance component Ra, was calculated from a Cole-Cole plot obtained from measurement performed by the experiment device 90 on the electricity removing member 27 of the comparative examples 1 to 15 and the disclosure examples 1 to 5. Here, in the comparative examples 1 to 4, 6, and 13 to 15, the resistance ratio (Rb/Ra) is higher than 0.4, and the condition of the above-indicated formula (3) that the resistance ratio (Rb/Ra) is equal to or lower than 0.4, is not satisfied. On the other hand, in the comparative examples 5 and 7 to 12, the resistance ratio (Rb/Ra) is equal to or lower than 0.4, and the condition of the above-indicated formula (3) that the resistance ratio (Rb/Ra) is equal to or lower than 0.4, is satisfied. However, in the comparative examples 1 to 6 and 10, the inner resistance component Ra of the electricity removing member 27 is higher than 6.9E+4.0, and the condition of the above-indicated formula (2) that the inner resistance component Ra of the electricity removing member 27 is equal to or lower than 6.9E+4.0, is not satisfied. The electricity removing capability of the comparative examples 1 to 6, 10, and 13 to 15 is evaluated as "x".

On the other hand, in the disclosure examples 1 to 5, the condition of the above-indicated formula (2) that the inner resistance component Ra of the electricity removing member 27 is equal to or lower than 6.9E+4.0, is satisfied, and the condition of the above-indicated formula (3) that the resistance ratio (Rb/Ra) is equal to or lower than 0.4, is satisfied. In addition, the electricity removing capability of the disclosure examples 1 to 5 is evaluated as "○".

In this way, it was found that, in the image forming apparatus 10, it is possible to obtain a desired electricity removing capability by taking into consideration not only the DC resistance value R2 of the electricity removing member 27, but also the inner impedance Z1 and the contact impedance Z2. More specifically, a desired electricity removing capability is obtained when the conditions of the above-indicated formulas (2) and (3) are satisfied.

Each value shown in FIG. 7 and FIG. 8, of the capacitance ratio (Cb/Ca), namely a ratio of the contact capacitance component Cb to the inner capacitance component Ca, was calculated from the Cole-Cole plot obtained from measurement performed by the experiment device 90 on the electricity removing member 27 of the comparative examples 1 to 15 and the disclosure examples 1 to 5. Here, in the comparative examples 1 to 4, 8, 9, and 12 to 15, the capacitance ratio (Cb/Ca) is higher than 0.4, and the condition of the above-indicated formula (5) that the capacitance ratio (Cb/Ca) is equal to or lower than 0.4, is not satisfied. On the other hand, in the comparative examples 5 to 7, 10 and 11, the capacitance ratio (Cb/Ca) is equal to or lower than 0.4, and the condition of the above-indicated formula (5) that the capacitance ratio (Cb/Ca) is equal to or lower than 0.4, is satisfied. However, in the comparative examples 1 to 3, 7, 8, and 10 to 13, the inner capacitance component Ca is higher than 1.0E+5.0, and the condition of the above-indicated formula (4) that the inner capacitance component Ca is equal to or lower than 1.0E+5.0, is not satisfied. With regard to the potential stability and the image memory presence/absence, an evaluation was made only on the samples whose electricity removing capability had been evaluated as "○". Specifically, in the comparative examples 7 to 9 and 11 to 12 whose electricity removing capability had been evaluated as "○", the potential stability and the image memory presence/absence were evaluated as "x".

On the other hand, in the disclosure examples 1 to 5, the condition of the above-indicated formula (4) that the inner capacitance component Ca is equal to or lower than 1.0E+5.0, is satisfied, and the condition of the above-indicated formula (5) that the capacitance ratio (Cb/Ca) is equal to or lower than 0.4, is satisfied. In addition, the potential stability and the image memory presence/absence of the disclosure examples 1 to 5 were evaluated as "○".

In this way, it was found that, in the image forming apparatus 10, it is possible to improve the potential stability and suppress an occurrence of the memory image by taking into consideration not only the DC resistance of the electricity removing member 27, but also the inner impedance Z1 and the contact impedance Z2. More specifically, the potential stability is improved and an occurrence of the memory image is suppressed when the conditions of the above-indicated formulas (4) and (5) are satisfied.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a photoconductor; and an electricity removing member electrically grounded and disposed to be in contact with a surface of the photoconductor, wherein with regard to a capacitance component of an inner impedance of the electricity removing member and a capacitance component of a contact impedance of the electricity removing member that are calculated from a Cole-Cole plot obtained from measurement by an AC impedance method in a predetermined frequency range, a value obtained by dividing the capacitance component of the contact impedance by the capacitance component of the inner impedance is equal to or lower than 0.4, and the capacitance component of the inner impedance is equal to or lower than 1.0E+05.

2. The image forming apparatus according to claim 1, wherein with regard to a resistance component of the inner impedance and a resistance component of the contact impedance, a value obtained by dividing the resistance component of the contact impedance by the resistance component of the inner impedance is equal to or lower than 0.4, and the resistance component of the inner impedance is equal to or lower than a value obtained by multiplying a calculated resistance value by 3, the calculated resistance value being calculated, based on a predetermined formula, as a DC resistance value of the electricity removing member that is required to reduce a pre-electricity-removal potential of the photoconductor to a post-electricity-removal potential in an electricity removal time that is obtained by dividing a contact width of the photoconductor and the electricity removing member by a linear speed of the photoconductor.

3. The image forming apparatus according to claim 2, wherein when C denotes a capacitance of the photoconductor, t denotes the electricity removal time, V0 denotes the pre-electricity-removal potential, V1 denotes the post-electricity-removal potential, and R21 denotes the calculated resistance value, the calculated resistance value R21 is calculated based on a following formula (1):

$$V1=V0\times e^{-t/(R21\cdot C)} \quad (1).$$

4. The image forming apparatus according to claim 1, wherein the photoconductor is charged by a contact-type charging member.

5. The image forming apparatus according to claim 1, wherein the photoconductor is charged by application of a DC voltage.

6. The image forming apparatus according to claim 1, wherein the electricity removing member is a roller-shaped member.

7. The image forming apparatus according to claim 6, wherein the electricity removing member includes a basic body portion and brush bristles, the basic body portion being cylindrical, one end of the brush bristles being fixed to the basic body portion, the other end of the brush bristles being brought into contact with the surface of the photoconductor, and each of the brush bristles includes a core portion and a surface layer portion, the core portion being made of resin, the surface layer portion being made of carbon and covering a surface of the core portion.

8. An image forming apparatus comprising:

a photoconductor; and an electricity removing member electrically grounded and disposed to be in contact with a surface of the photoconductor, wherein with regard to a resistance component of an inner impedance of the electricity removing member and a resistance component of a contact impedance of the electricity removing member that are calculated from a Cole-Cole plot obtained from measurement by an AC impedance method in a predetermined frequency range, a value obtained by dividing the resistance component of the contact impedance by the resistance component of the inner impedance is equal to or lower than 0.4, and the resistance component of the inner impedance is equal to or lower than a value obtained by multiplying a calculated resistance value by 3, the calculated resistance value being calculated, based on a predetermined formula, as a DC resistance value of the electricity removing member that is required to reduce a pre-electricity-removal potential of the photoconductor to a post-electricity-removal potential in an electricity removal time that is obtained by dividing a contact width of the photoconductor and the electricity removing member by a linear speed of the photoconductor.

9. The image forming apparatus according to claim 8, wherein when C denotes a capacitance of the photoconductor, t denotes the electricity removal time, V0 denotes the pre-electricity-removal potential, V1 denotes the post-electricity-removal potential, and R21 denotes the calculated resistance value, the calculated resistance value R21 is calculated based on a following formula (2):

$$V1=V0\times e^{-t/(R21\cdot C)} \quad (2).$$

10. The image forming apparatus according to claim 8, wherein the photoconductor is charged by a contact-type charging member.

11. The image forming apparatus according to claim 8, wherein the photoconductor is charged by application of a DC voltage.

12. The image forming apparatus according to claim 8, wherein the electricity removing member is a roller member.

13. The image forming apparatus according to claim 12, wherein the electricity removing member includes a basic body portion and brush bristles, the basic body portion being cylindrical, one end of the brush bristles being fixed to the basic body portion, the other end of the brush bristles being brought into contact with the surface of the photoconductor, and each of the brush bristles includes a core portion and a surface layer portion, the core portion being made of resin, the surface layer portion being made of carbon and covering a surface of the core portion.

* * * * *